US012723364B2

(12) United States Patent
Kumbhar et al.

(10) Patent No.: US 12,723,364 B2
(45) Date of Patent: Sep. 1, 2026

(54) WORK MACHINE WITH A LIFT LINKAGE ASSEMBLY

(71) Applicant: Deere & Company, Moline, IL (US)

(72) Inventors: Nilesh T. Kumbhar, Karad (IN); Brett S. Graham, Dubuque, IA (US); Eric Vilar, Dubuque, IA (US); Giovanni A. Wuisan, Epworth, IA (US)

(73) Assignee: Deere & Company, Moline, IL (US)

( * ) Notice: Subject to any disclaimer, the term of this patent is extended or adjusted under 35 U.S.C. 154(b) by 376 days.

(21) Appl. No.: 18/499,744

(22) Filed: Nov. 1, 2023

(65) Prior Publication Data

US 2025/0137219 A1 May 1, 2025

(51) Int. Cl.
*E02F 3/34* (2006.01)
*E02F 3/38* (2006.01)

(52) U.S. Cl.
CPC ..... *E02F 3/3414* (2013.01); *E02F 3/38* (2013.01)

(58) Field of Classification Search
None
See application file for complete search history.

(56) References Cited

U.S. PATENT DOCUMENTS 5,984,618 A * 11/1999 Deneve ..... E02F 3/3408 414/706
6,751,895 B2 6/2004 Paumier
6,957,705 B2 10/2005 O'Brien et al.
8,459,927 B2 * 6/2013 England ..... E02F 3/3405 414/685
9,803,332 B2 10/2017 Tanaka et al.
9,988,786 B2 6/2018 Martin et al.
10,156,053 B2 12/2018 Hren
10,189,512 B2 1/2019 Dehnert et al.
10,443,209 B2 10/2019 Kumbhar et al.
2014/0158440 A1 6/2014 Haar et al.
2018/0258606 A1 9/2018 Azure et al.

FOREIGN PATENT DOCUMENTS

DE 1222856 B 8/1966
EP 2280122 A1 2/2011

OTHER PUBLICATIONS

German Search Report issued in application No. 102024125069.0 dated Apr. 9, 2025, 10 pages.

* cited by examiner

*Primary Examiner* — Michael S Lowe

(57) ABSTRACT

A work machine comprising of a frame extending longitudinally, a ground-engaging unit supporting the frame, and an operator cab coupled to the frame. A boom is pivotally coupled to a rear portion of the frame and coupled to the attachment coupler at a forward portion of the boom. The boom extends longitudinally and is configured to move the attachment coupler from a first position to a second position relative to the frame along a lift path. A boom lift assembly couples the rear portion of the boom to the frame and wherein the boom lift assembly guides the boom to move the attachment coupler along the lift path.

14 Claims, 9 Drawing Sheets

WORK MACHINE WITH A LIFT LINKAGE ASSEMBLY

TECHNICAL FIELD

The present disclosure relates generally to work machines with a lift linkage assembly for improved visibility.

BACKGROUND

All around visibility is desirable in smaller work machines because these work machines generally operate in tight spaces. Premium products often offer advanced awareness of an operator's surroundings through the addition of expensive and complex technologies such as sensors, cameras, etc. Although these tools may improve ease of operation capability by adding on to existing designs or retrofitting current work machines, therein lies an opportunity for a simplified approach to improved visibility on smaller work machines. A work machine with improved visibility that may require fewer components and thereby reduced costs with the effect of improving the operator's ability to work in indoor applications.

SUMMARY

According to an aspect of the present disclosure, a work machine of smaller scale, such as a compact track loader is shown. The work machine comprises of a frame extending longitudinally, a ground-engaging unit supporting the frame, and an operator cab coupled to the frame. A boom is pivotally coupled to a rear portion of the frame and coupled to the attachment coupler at a forward portion of the boom. The boom extends longitudinally and is configured to move the attachment coupler from a first position to a second position relative to the frame along a lift path. A boom lift assembly couples the rear portion of the boom to the frame, wherein the boom lift assembly guides the boom to move the attachment coupler along the lift path.

The boom lift assembly further includes a bar extending longitudinally and connected to the rear portion of the frame. The bar has a first bar junction forward of a second bar junction. The first bar junction and the second bar junction are at opposing ends of the bar. A lower link extends rearward of the second bar junction. A first lower link end is pivotally coupled to the frame at the second bar junction. A second lower link end pivotally coupled to a rearmost boom junction. A first distance is defined as the distance between the second bar junction and the rearmost boom junction. An upper link extends rearward of the first bar junction. A first upper link end is coupled to the frame at an upper link junction located above the bar and between the first bar junction and the second bar junction. The second upper link end is pivotally coupled to the boom at a second rearmost boom junction. An actuator extends rearward of the first bar junction. A first actuator end is pivotally coupled to the frame at the first bar junction. A second actuator end is pivotally coupled to the boom at a third rearmost boom junction.

A second distance is defined as between the first rearmost boom junction and the second rearmost boom junction. The length ratio of the second distance to the first distance is 0.2 to 0.3. A third distance being defined as between the first upper link junction and the second rearmost junction, the length ratio of the third distance to the first distance is in the length ratio range of 1.1 and 1.2. A fourth distance being defined as between upper link junction and the second bar junction, the length ratio of the fourth distance to the first distance is in the length ratio range of 0.4 and 0.5.

The operator cab is forwardly biased away from the frame center.

The boom and boom lift assembly are mirrored across a longitudinal centerline of frame. A support bar is transversely oriented from the longitudinal centerline and couples the lower links of a left boom lift assembly and a right boom lift assembly.

The ground-engaging unit comprises of a tracked frame. This includes a track-chain extending around an outer periphery of a track frame. A first idler wheel and a second idler wheel rotatably coupled to the longitudinally opposed track frame end portions. A drive sprocket is mounted rearward of the track frame.

A drive sprocket center axis is elevated relative to an idler wheel center axis. The drive sprocket and the second idler wheel are located directly below the boom lift assembly. In an alternative embodiment, the ground engaging unit comprises of wheels. The angle between the rear portion the boom and the fore portion of the boom is at least 150 degrees.

Other features and aspects will become apparent by consideration of the detailed description, claims, and accompanying drawings.

BRIEF DESCRIPTION OF THE DRAWINGS

The detailed description of the drawings refers to the accompanying figures.

Like reference numerals are used to indicate like elements throughout the several figures.

DETAILED DESCRIPTION

Figure 1:
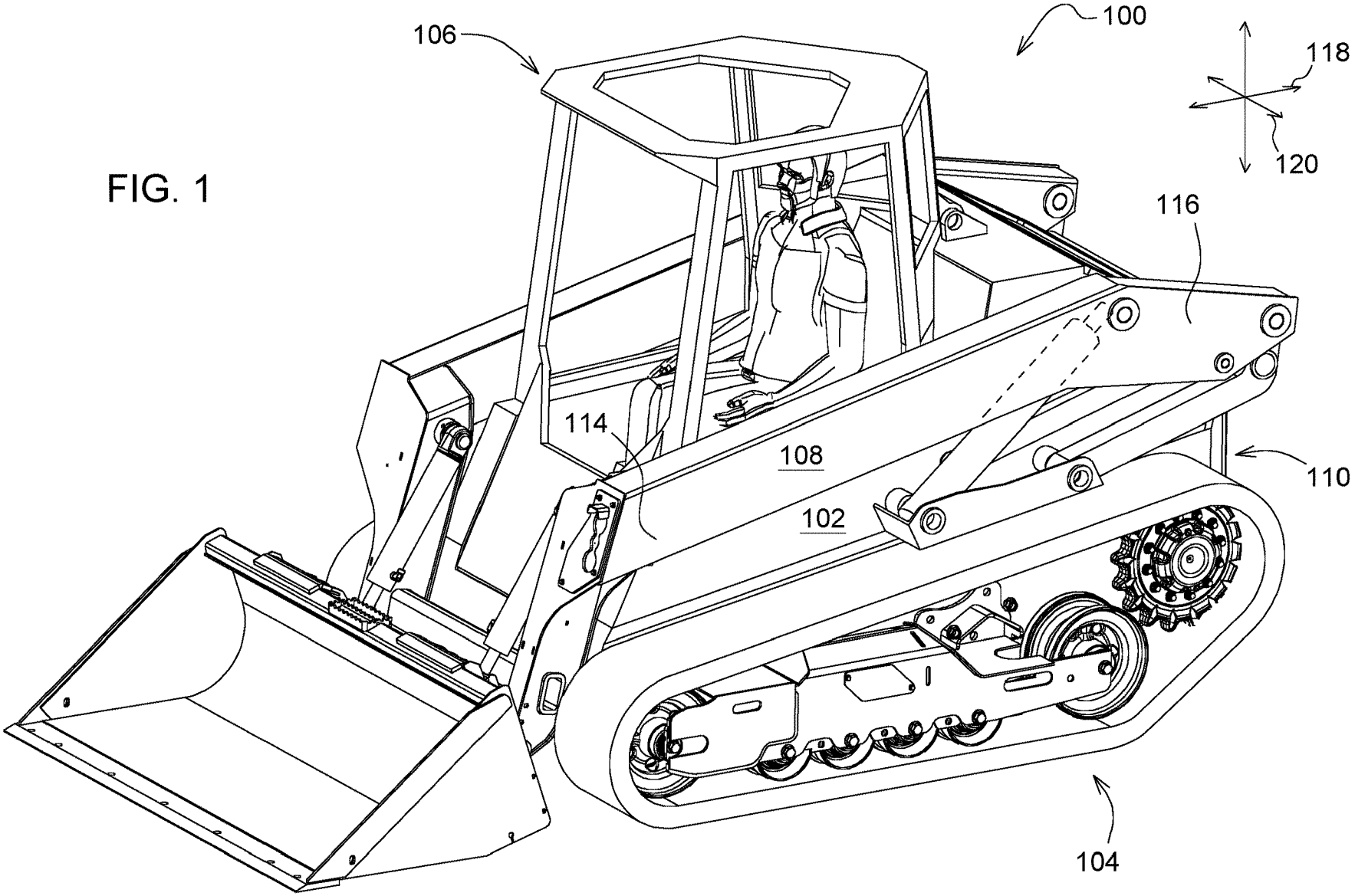
FIG. 1 is an isometric view of a work machine with the lift linkage assembly.

Referring to FIG. 1, a work machine 100 of smaller scale, or more specifically, a compact track loader is shown. The work machine 100 comprises of a frame 102 extending longitudinally 118, a ground-engaging unit 104 supporting the frame 102, and an operator cab 106 coupled to the frame 102. A rear portion 110 of the boom 108 is pivotally coupled to the rear portion 116 of the frame 102. An attachment coupler 112 is coupled to at the forward portion 114 of the boom 108. The boom 108 extends longitudinally 118 and is configured to move the attachment coupler 112 from a first position 122 to a second position 124 relative to the frame 102, anywhere along a lift path 126 (shown in FIG. 7A). A boom lift assembly 128 couples the rear portion 116 of the boom 108 to the frame 102, wherein the boom lift assembly 128 (as seen in FIG. 3B) guides the boom 108 to move the attachment coupler 112 along the lift path 126.

Figure 3A:
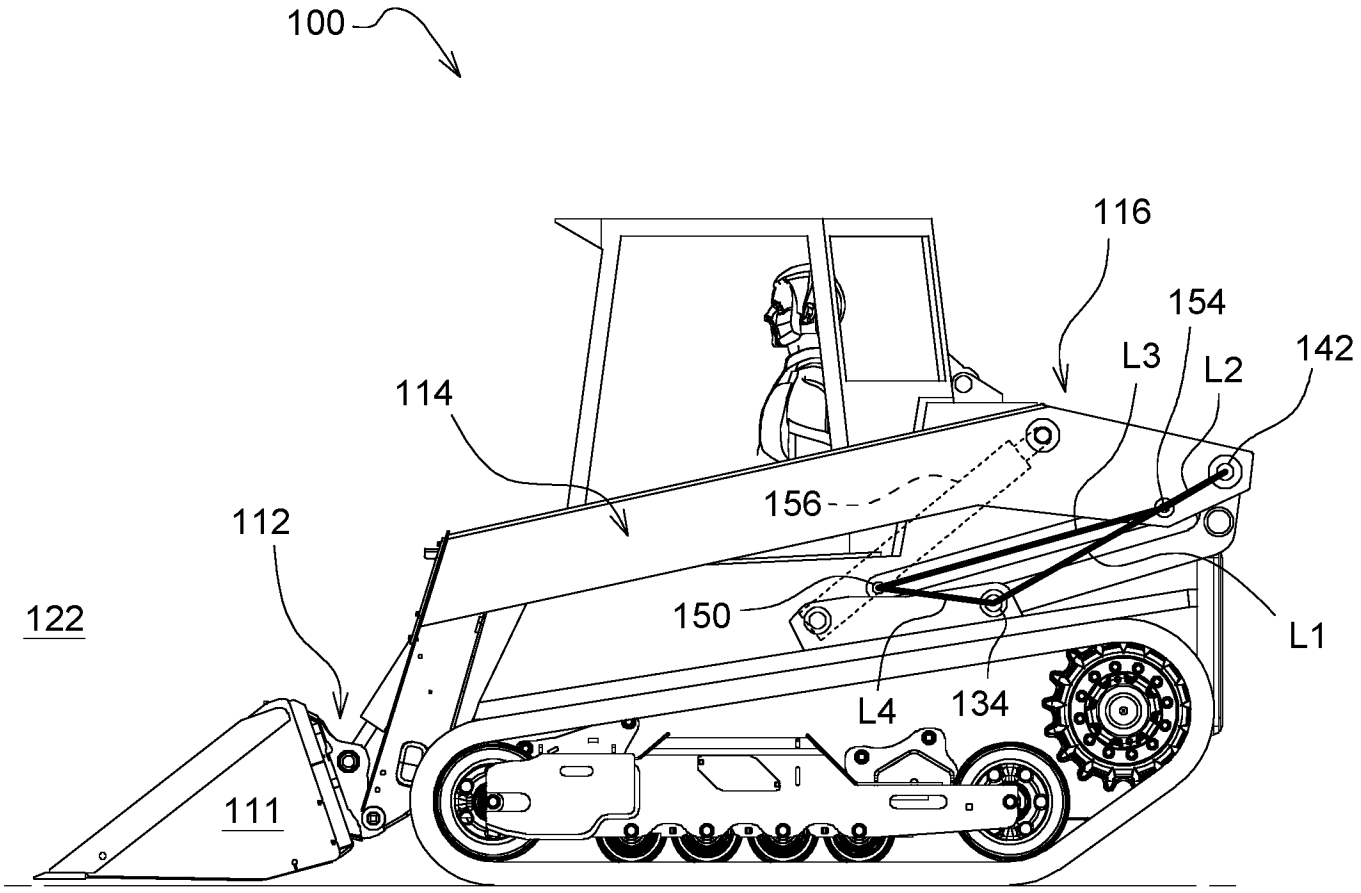
FIG. 3A is a side view of the work machine shown in FIG. 1, with the actuator fully retracted.

The boom lift assembly 128 includes a bar 130 extending substantially longitudinally 118, or in a fore-aft direction of the work machine 100, and connected to the rear portion 116 of the frame 102. The bar 130 has a first bar junction 132 forward of a second bar junction 134, wherein the first bar junction 132 is approximately positioned towards a frame center 164. The first bar junction 132 and the second bar junction 134 are at opposing ends of the bar 130. A lower link 136 extends rearward of the second bar junction 134. A first lower link end 138 is pivotally coupled to the frame 102 at the second bar junction 134. A second lower link end 140 pivotally coupled to a rearmost boom junction 142. A first distance L1 (as shown in FIG. 3A) is defined as the distance between the second bar junction 134 and the rearmost boom junction 142. An upper link 146 extends rearward of the first bar junction 132. A first upper link end 148 is coupled to the frame 102 at an upper link junction 150 located above the bar 130 and between the first bar junction 132 and the second bar junction 134. The second upper link end 152 is pivotally coupled to the boom 108 at a second rearmost boom junction 154. An actuator 156 extends rearward of the first bar junction 132. A first actuator end 158 is pivotally coupled to the frame 102 at the first bar junction 132. A second actuator end 160 is pivotally coupled to the boom 108 at a third rearmost boom junction 162.

Figure 3B:
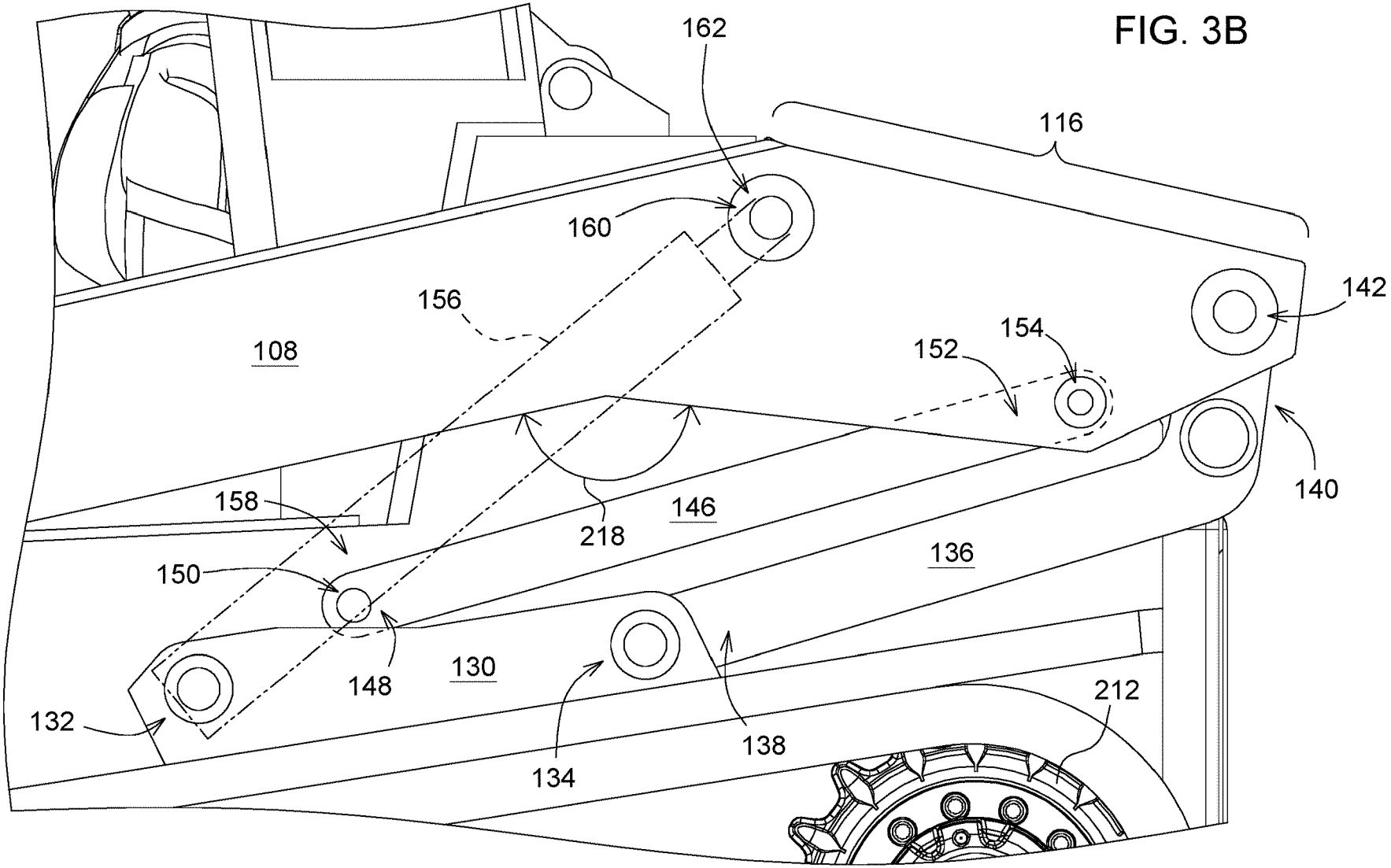
FIG. 3B is a detailed view of a portion of the work machine shown in FIG. 3A, or more specifically the area with the lift linkage assembly.

With continued reference to FIGS. 3A-3B, the second distance L2 is defined as between the rearmost boom junction 142 and the second rearmost boom junction 154. The length ratio of the second distance L2 to the first distance L1 is in the length ratio range of 0.2 to 0.3. A third distance L3 is defined as between the first upper link junction 150 and the second rearmost boom junction 154, wherein the length ratio of the third distance L3 to the first distance L1 is in the length ratio range of 1.1 and 1.2. A fourth distance L4 is defined as between upper link junction 150 and the second bar junction 134, the length ratio of the fourth distance L4 to the first distance L1 is in the length ratio range of 0.4 and 0.5.

The operator cab 106 is forwardly biased away from the frame center 164.

Figure 2:
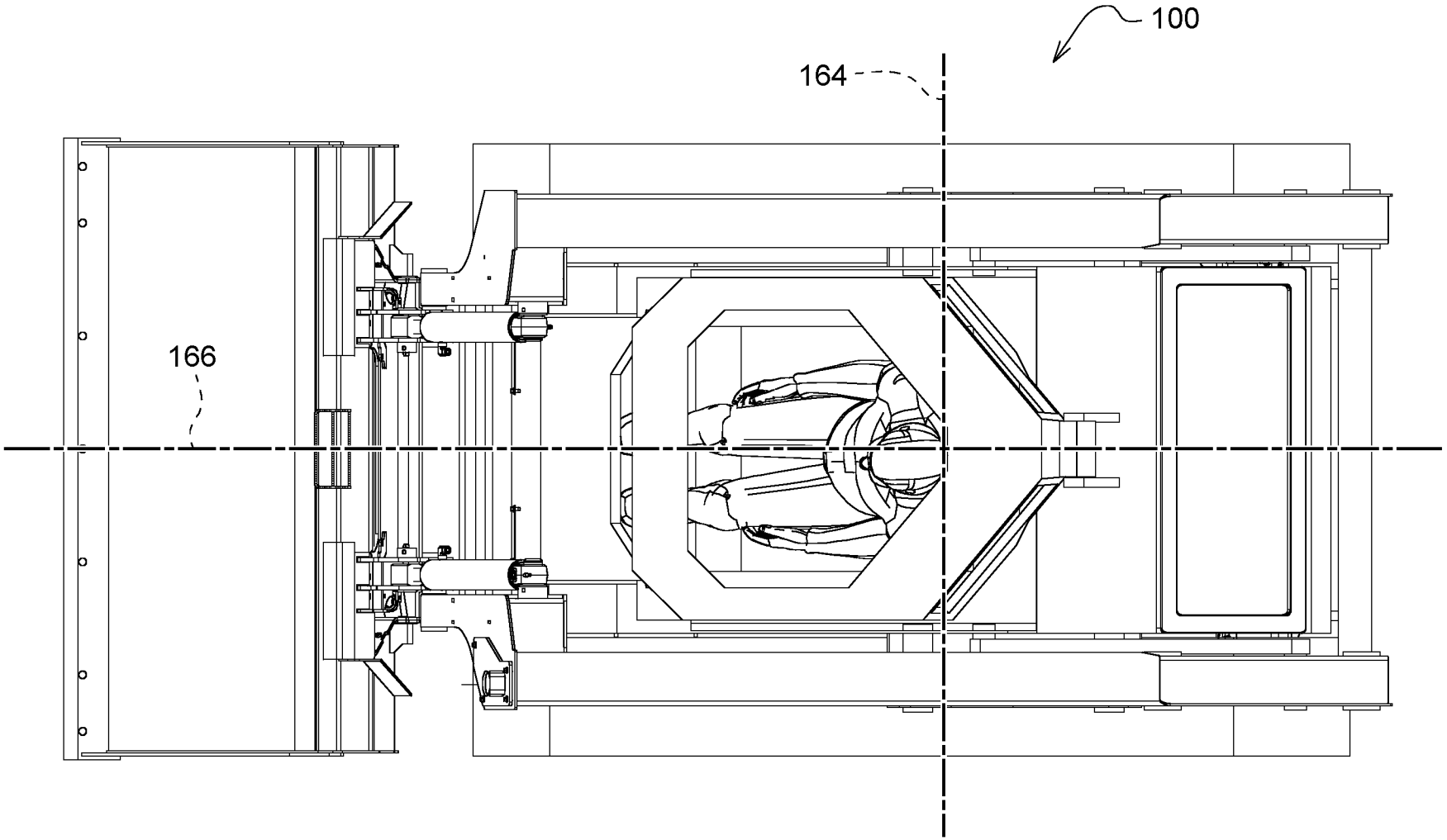
FIG. 2 is a top view of the work machine shown in FIG. 1.
Figure 6:
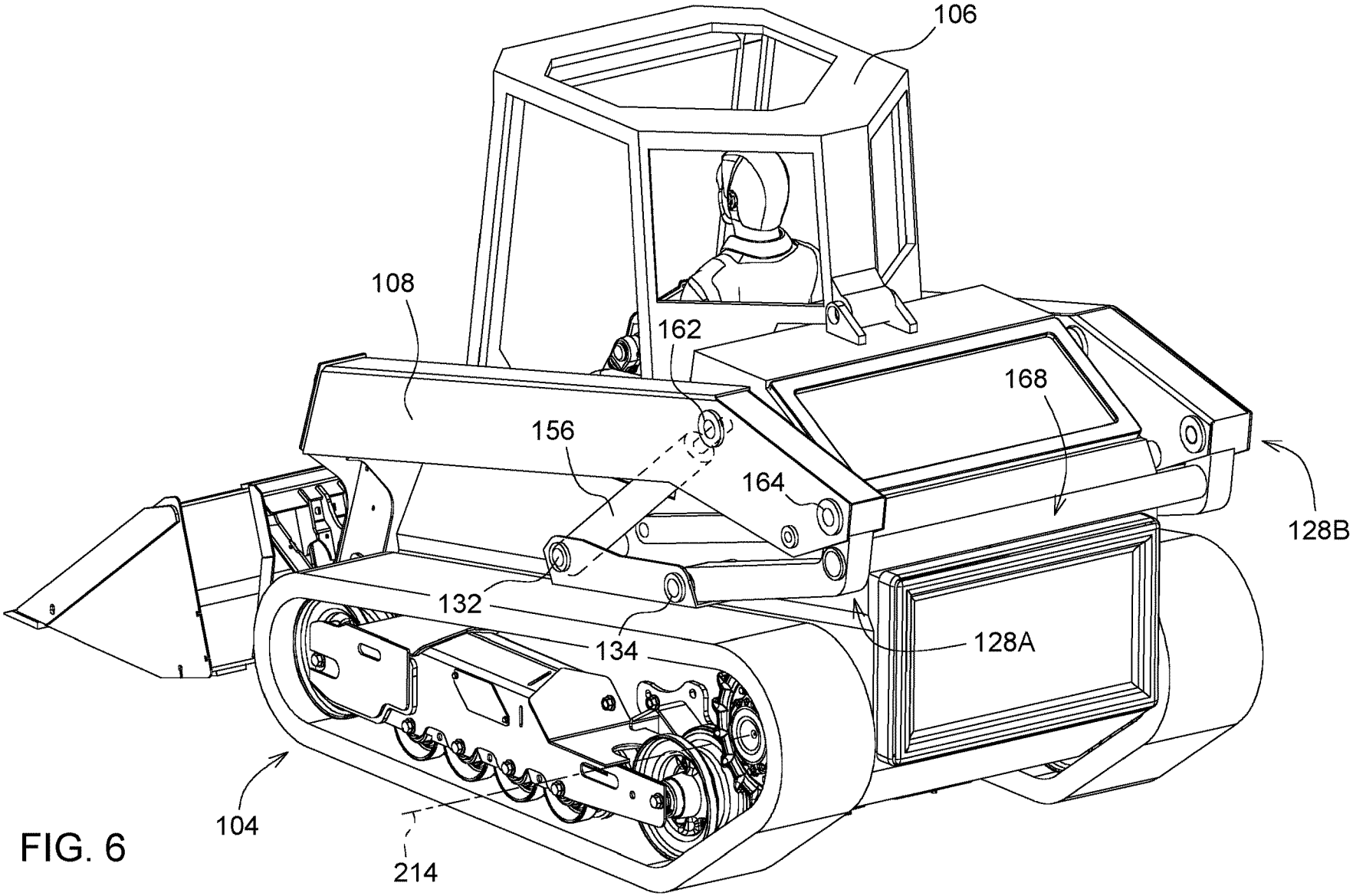
FIG. 6 is a rear isometric view of the work machine shown in FIG. 1.

The boom 108 and boom lift assembly 128 are mirrored across a longitudinal centerline 166 of the frame 102 as seen in the top view of FIG. 2. Now herein, also referring to FIG. 6, a support bar 168 is transversely oriented from the longitudinal centerline 166 and couples the lower links 136 of each the left boom lift assembly 128*a* and right boom lift assembly 128*b*. Furthermore, the support bar 168 sits below the sight line of the operator.

Figure 4:
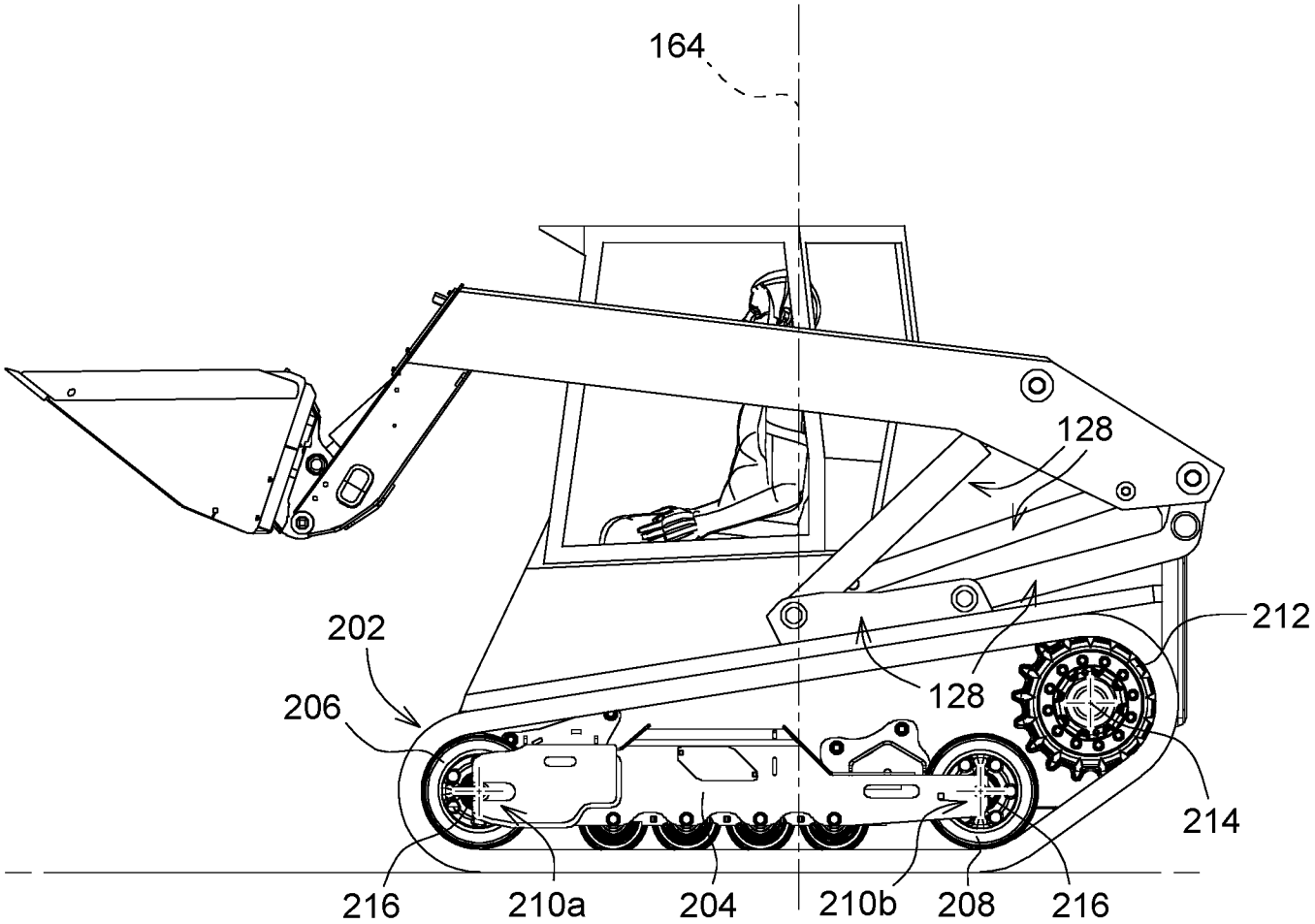
FIG. 4 is side view of the work machine shown in FIG. 1, with the actuator partially extended.

Now turning to FIG. 4, the ground-engaging unit 104 may comprise of a tracked undercarriage. This includes a track-chain 202 extending around an outer periphery of a track frame 204. A first idler wheel 206 and a second idler wheel 208 are rotatably coupled to the longitudinally opposed track frame end portions (210*a*, 210*b*). A drive sprocket 212 is mounted rearward of the track frame 204.

A drive sprocket center axis 214 is elevated relative to an idler wheel center axis 216. The drive sprocket 212 and the second idler wheel 208 are positioned below the boom lift assembly 128. In an alternative embodiment, the ground engaging unit may comprise of wheels (not shown). Positioning of the drive sprocket 212 as shown, advantageously further compliments electric drive work machines in addition to the standard engines because the substantive portion of the base allows ample room for battery placement while improving the weight balancing of the work machine. Similar to the tracked undercarriage, a wheeled drive would also include the drive sprocket towards the rear of the frame and below the boom lift assembly. The angle 218 between the rear portion 116 the boom 108 and the forward portion 114 of the boom 108 is at least one hundred-fifty degrees.

Figure 5:
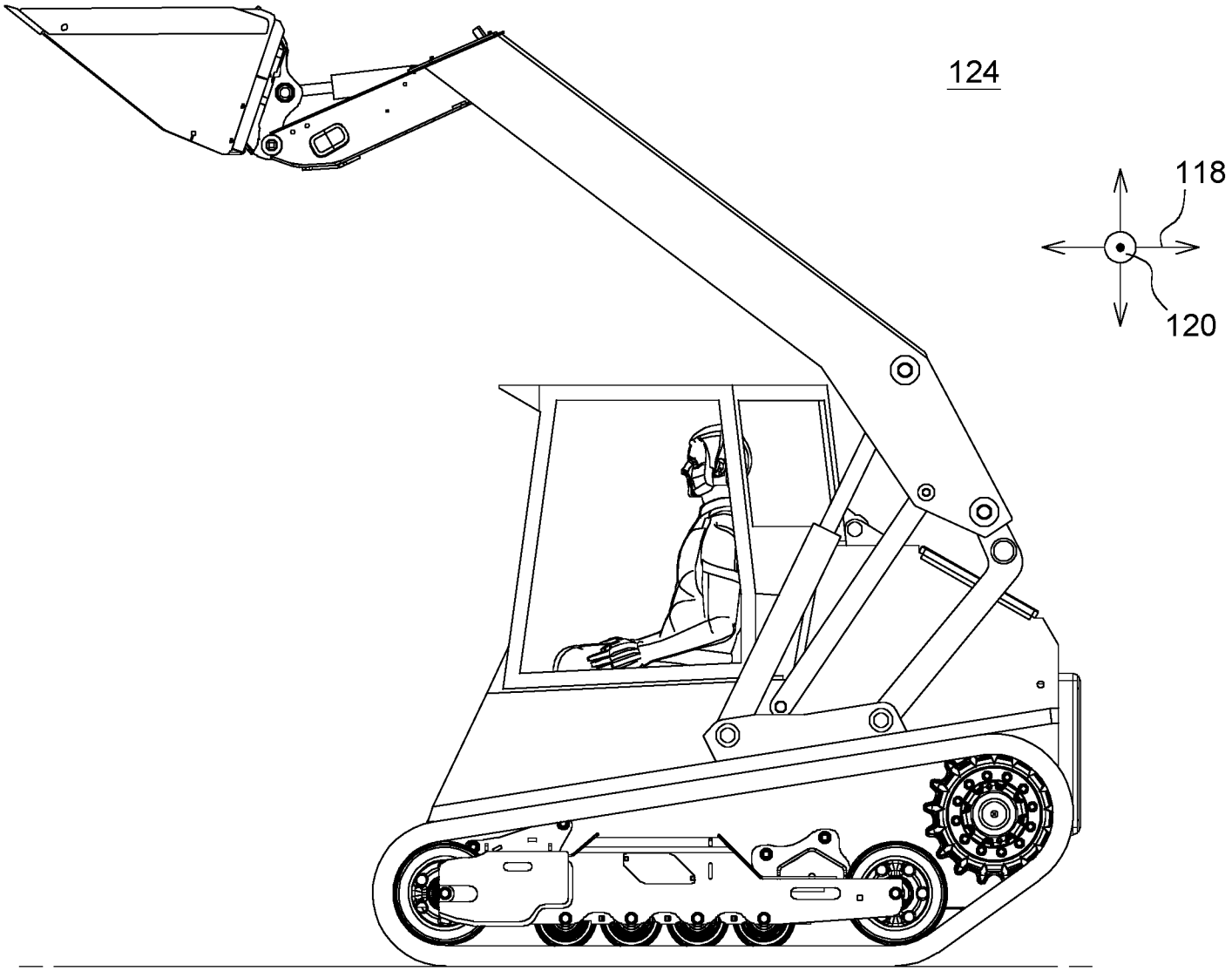
FIG. 5 is a side view of the work machine shown in FIG. 1, with the actuator fully extended.
Figure 7B:
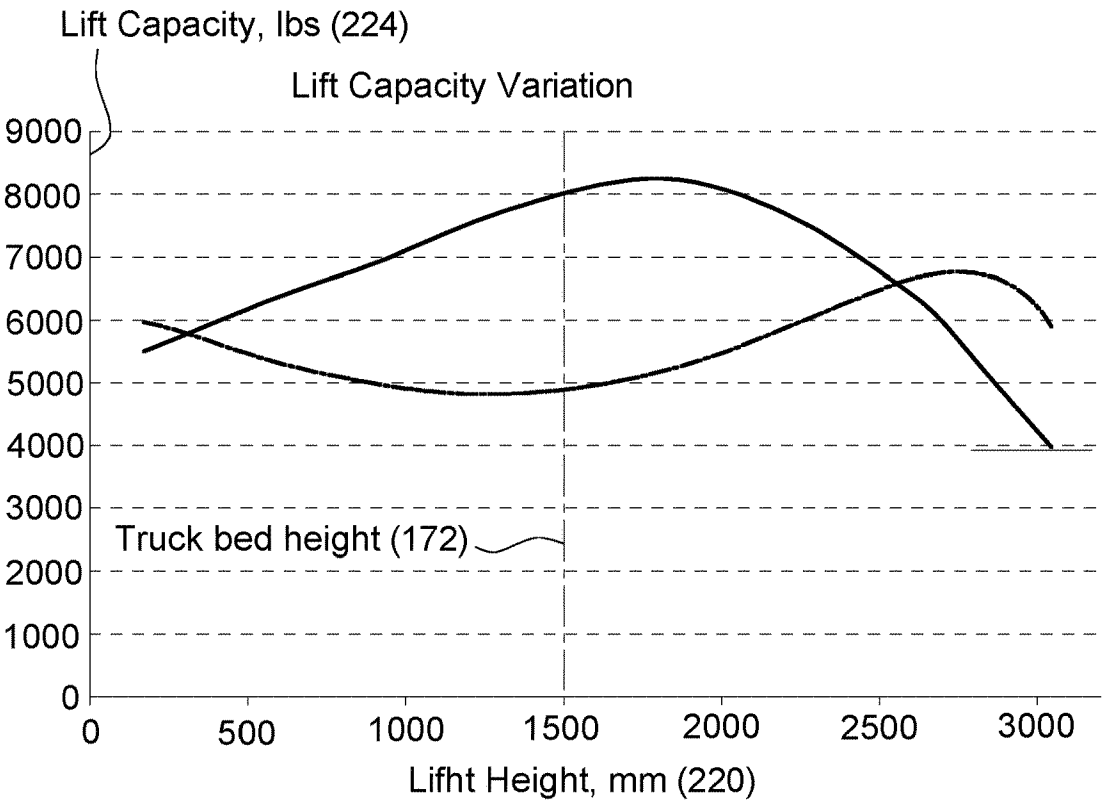
FIG. 7B is the lift capacity as the attachment coupler moves along the lift path for the embodiment shown in FIG. 1 versus the prior art.
Figure 7A:
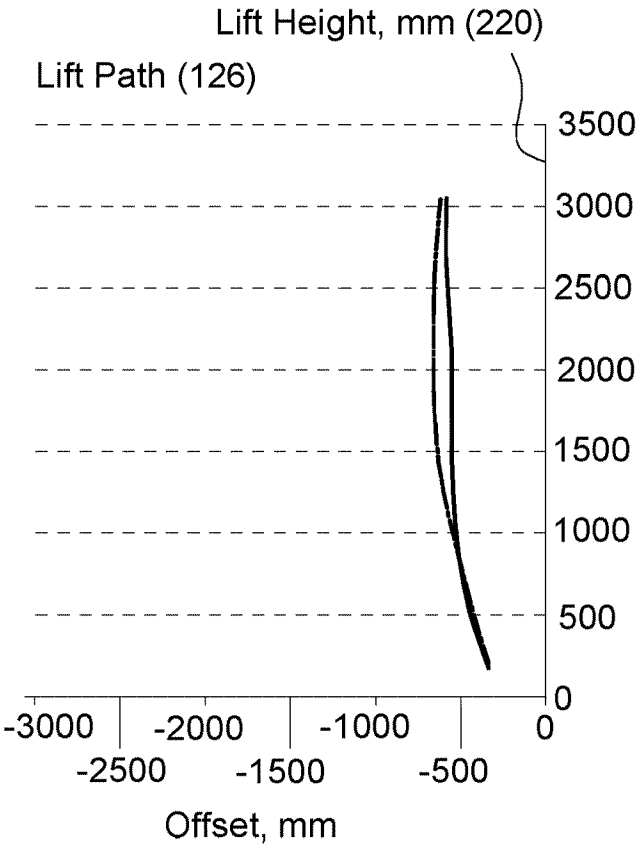
FIG. 7A is the lift path of the attachment coupler with the embodiment of the boom assembly shown in FIG. 1.

Now turning to FIGS. 7A-7B, and without in any way limiting the scope, interpretation, or application of the claims appearing below, a technical effect of the embodiment disclosed is generation of a true vertical lift path while improving the lift capacity 224. The unique linkage configuration of the boom lift assembly enables a substantial vertical lift (FIG. 7A) as the actuator reaches full extension (shown in FIG. 5). FIG. 7B discloses a graph outlining the lift capacity 224 variation of the present embodiment versus the prior art. The x-axis represents the A lift height.

The y-axis represents the lift capacity 224. An average truck bed height 172 is shown by the vertical dotted line at which the maximum lift capacity 224 is at least 25% more than the prior art as. The prior art shown is a Deere 317G compact track loader.

Figure 8B:
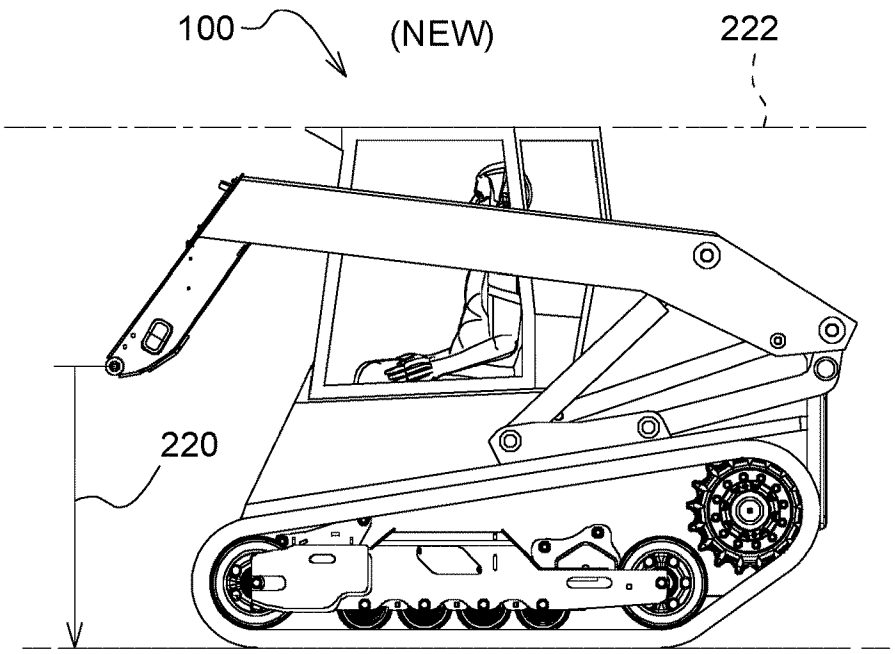
FIG. 8B is a side view of the work machine in FIG. 1.
Figure 8A:
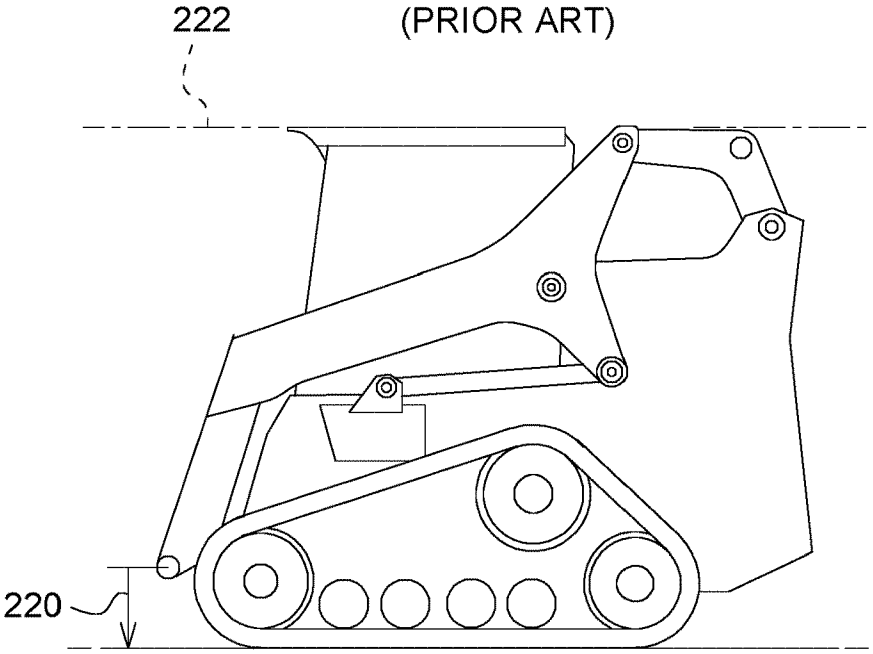
FIG. 8A is a side view schematic of the PRIOR ART.

Another technical effect of one the exemplary embodiment disclosed herein is improved ease of use for indoor applications. FIG. 8A discloses an exemplary prior art shown as a compact track loader. The ceiling 222 shown in both FIGS. 8A and 8B may defined as a planar surface coinciding with the top surface of the operator cab. The boom lift assembly 128 operatively coupled to the boom, in the present embodiment in FIG. 8B enables an operator to lift an attachment coupler, or alternatively the end of the boom 108 to at least a height 220 of fifty inches before any potential of interference of the boom 108 with the ceiling 222. The height 220 achieved by the end of the boom 108 in the present embodiment (FIG. 8B) is substantially larger than the maximum height of the end of boom 108 achieved before any potential interference of the boom 108 or boom lift assembly 128 with ceiling (shown in FIG. 8A).

Another technical effect of the example embodiment disclosed herein is the enhanced visibility and thereby reduction of the need for more cameras, and sensors to achieve a similar visibility. FIG. 8A discloses prior art with a boom and frame configuration with limited rear visibility due to the pillar-like structures in the rear.

As used herein, "e.g." is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Terms of degree, such as "generally", "substantially" or "approximately" are understood by those of ordinary skill to refer to reasonable ranges outside of a given value or orientation, for example, general tolerances or positional relationships associated with manufacturing, assembly, and use of the described embodiments.

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A work machine comprising:
a frame extending longitudinally;
a ground-engaging unit supporting the frame;
an operator cab coupled to the frame;
an attachment coupler;
a boom is pivotally coupled to the attachment coupler at a forward portion of the boom, the boom extending longitudinally and configured to move the attachment coupler from a first position to a second position relative to the frame along a lift path; and
a boom lift assembly coupling a rear portion of the boom to the frame, the boom lift assembly guiding the boom to move the attachment coupler along the lift path,
wherein the boom lift assembly includes
a bar extending longitudinally and connected to the rear portion of the frame, the bar having a first bar junction forward of a second bar junction, the first bar junction and the second bar junction at opposing ends of the bar;
a lower link extending rearward of the second bar junction, a first lower link end pivotally coupled to the frame at the second bar junction, a second lower link end pivotally coupled to a rearmost boom junction; a first distance being defined between the second bar junction and the rearmost boom junction;
an upper link extending rearward of the first bar junction, a first upper
link end coupled to the frame at an upper link junction located above the bar and between the first bar junction and the second bar junction, a second upper link end pivotally coupled to the boom at a second rearmost boom junction; and
an actuator extending rearward of the first bar junction, a first actuator end pivotally coupled to the frame at the first bar junction, a second actuator end pivotally coupled to the boom at a third rearmost boom junction
wherein the boom and the boom lift assembly are mirrored across a longitudinal centerline of the frame,
and a support bar transversely oriented from the longitudinal centerline and couples the lower links of a left boom lift assembly and a right boom lift assembly, the support bar sitting below the line of sight of the operator.

2. The work machine of claim 1, wherein a second distance being defined as between the rearmost boom junction and the second rearmost boom junction, a length ratio of the second distance to the first distance being 0.2 to 0.3.

3. The work machine of claim 2, wherein a third distance being defined as between the first upper link junction and the second rearmost junction, the length ratio of the third distance to the first distance is in a length ratio range of 1.1 and 1.2.

4. The work machine of claim 3, wherein a fourth distance being defined as between the upper link junction and the second bar junction, the length ratio of the fourth distance to the first distance is in the length ratio range of 0.4 and 0.5.

5. The work machine of claim 1, wherein the operator cab is forwardly biased away from a frame center.

6. The work machine of claim 1, wherein the ground-engaging unit comprises of:
a track frame;
a track-chain extending around an outer periphery of a track frame;
a first idler wheel and a second idler wheel rotatably coupled to longitudinally opposed track frame end portion; and
a drive sprocket mounted rearward of the track frame.

7. The work machine of claim 6, wherein a drive sprocket center axis is elevated relative to an idler wheel center axis.

8. The work machine of claim 6, wherein the drive sprocket and the second idler wheel are located directly below the boom lift assembly.

9. The work machine of claim 6, wherein the ground-engaging unit comprises of wheels.

10. The work machine of claim 1, wherein the angle between the rear portion of the boom and fore portion of the boom is at least 150 degrees.

11. A compact track loader comprising:
a frame extending longitudinally;
a ground-engaging unit supporting the frame;
an operator cab coupled to the frame;
an attachment coupler;
a boom is pivotally coupled to the attachment coupler at a forward portion of the boom, the boom extending longitudinally and configured to move the attachment coupler from a first position to a second position relative to the frame along a lift path; and
a boom lift assembly coupling a rear portion of the boom to the frame, the boom lift assembly guiding the boom to move the attachment coupler along the lift path,
wherein the boom lift assembly includes
a bar extending longitudinally and connected to the rear portion of the frame, the bar having a first bar junction forward of a second bar junction, the first bar junction and the second bar junction at opposing ends of the bar;
a lower link extending rearward of the second bar junction, a first lower link end pivotally coupled to the frame at the second bar junction,
a second lower link end pivotally coupled to a rearmost boom junction; a first distance being defined between the second bar junction and the rearmost boom junction;
an upper link extending rearward of the first bar junction, a first upper link end coupled to the frame at an upper link junction located above the bar and between the first bar junction and the second bar junction, a second upper link end pivotally coupled to the boom at a second rearmost boom junction; and
an actuator extending rearward of the first bar junction, a first actuator end pivotally coupled to the frame at the first bar junction, a second actuator end pivotally coupled to the boom at a third rearmost boom junction, wherein a second distance being defined as between the rearmost boom junction and the second rearmost boom junction, a length ratio of the second distance to the first distance being in a length ratio range of 0.2 to 0.3, wherein a third distance being defined as between the upper link junction and the second rearmost junction, the length ratio of the third distance to the first distance is in the length ratio range of 1.1 and 1.2, and wherein a fourth distance being defined as between the upper link junction and the second bar junction, the length ratio of the fourth distance to the first distance is in the length ratio range of 0.4 and 0.5 and a support bar transversely oriented from the longitudinal centerline and couples the lower links of a left boom lift assembly and a right boom lift assembly, the support bar sitting below the line of sight of the operator.

12. The compact track loader of claim 11, wherein an angle between the rear portion of the boom and fore portion of the boom is at least 150 degrees.

13. A work machine linkage assembly comprising:

a boom is pivotally coupled to the attachment coupler at a forward portion of the boom, the boom extending longitudinally and configured to move the attachment coupler from a first position to a second position relative to the frame along a lift path; and a boom lift assembly coupling a rear portion of the boom to the frame, the boom lift assembly guiding the boom to move the attachment coupler along the lift path, wherein the boom lift assembly includes a bar extending longitudinally and connected to the rear portion of the frame, the bar having a first bar junction forward of a second bar junction, the first bar junction and the second bar junction at opposing ends of the bar;

a lower link extending rearward of the second bar junction, a first lower link end pivotally coupled to the frame at the second bar junction, a second lower link end pivotally coupled to a rearmost boom junction; a first distance being defined between the second bar junction and the rearmost boom junction;

an upper link extending rearward of the first bar junction, a first upper link end coupled to the frame at an upper link junction located above the bar and between the first bar junction and the second bar junction, a second upper link end pivotally coupled to the boom at a second rearmost boom junction; and an actuator extending rearward of the first bar junction, a first actuator end pivotally coupled to the frame at the first bar junction, a second actuator end pivotally coupled to the boom at a third rearmost boom junction, wherein a second distance being defined as between the rearmost boom junction and the second rearmost boom junction, a length ratio of the second distance to the first distance being 0.2 to 0.3, wherein a third distance being defined as between the upper link junction and the second rearmost junction, the length ratio of the third distance to the first distance is in the length ratio range of 1.1 and 1.2, and wherein a fourth distance being defined as between upper link junction and the second bar junction, the length ratio of the fourth distance to the first distance is in the length ratio range of 0.4 and 0.5 and a support bar transversely oriented from the longitudinal centerline and couples the lower links of a left boom lift assembly and a right boom lift assembly, the support bar sitting below the line of sight of the operator.

14. The work machine linkage assembly of claim 13, wherein an angle between the rear portion of the boom and fore portion of the boom is at least 150 degrees.

* * * * *